US008565628B2

(12) United States Patent
Henderson

(10) Patent No.: US 8,565,628 B2
(45) Date of Patent: Oct. 22, 2013

(54) ELECTROPHOTOGRAPHIC NON-UNIFORMITY COMPENSATION USING INTENTIONAL PERIODIC VARIATION

(75) Inventor: Thomas Allen Henderson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 412 days.

(21) Appl. No.: 13/040,297

(22) Filed: Mar. 4, 2011

(65) Prior Publication Data

US 2012/0226466 A1 Sep. 6, 2012

(51) Int. Cl.
*G03G 15/00* (2006.01)

(52) U.S. Cl.
USPC ..... 399/49; 399/48

(58) Field of Classification Search
USPC ..... 399/49, 48
See application file for complete search history.

(56) References Cited

U.S. PATENT DOCUMENTS

| | | | | |
|---|---|---|---|---|
| 4,578,678 | A | 3/1986 | Hurd | |
| 5,872,586 | A * | 2/1999 | Shio | 347/116 |
| 5,881,346 | A * | 3/1999 | Mori et al. | 399/301 |
| 6,608,641 | B1 | 8/2003 | Alexandrovich et al. | |
| 6,728,503 | B2 | 4/2004 | Stelter et al. | |
| 7,058,325 | B2 | 6/2006 | Hamby et al. | |
| 7,120,379 | B2 | 10/2006 | Eck | |
| 7,755,799 | B2 | 7/2010 | Paul et al. | |
| 7,855,679 | B1 | 12/2010 | Braiman | |
| 2006/0071963 | A1 * | 4/2006 | Sampath et al. | 347/19 |
| 2006/0133870 | A1 | 6/2006 | Ng et al. | |
| 2008/0226361 | A1 | 9/2008 | Tomita et al. | |
| 2010/0097657 | A1 | 4/2010 | Kuo et al. | |
| 2010/0329710 | A1 * | 12/2010 | Yamazaki | 399/49 |
| 2011/0052228 | A1 * | 3/2011 | Kozitsky et al. | 399/49 |
| 2011/0243582 | A1 * | 10/2011 | Matsumoto et al. | 399/15 |

OTHER PUBLICATIONS

U.S. Appl. No. 12/748,762, filed Mar. 29, 2010, Tai et al.

* cited by examiner

*Primary Examiner* — David Gray
*Assistant Examiner* — G. M. Hyder
(74) *Attorney, Agent, or Firm* — Christopher J. White

(57) ABSTRACT

Non-uniformity of a rotatable electrophotographic imaging component is compensated. The component has an intentional periodic variation that produces density variations in a test target. The angular position on the component of the intentional variation is correlated with the amount of an unintentional variation at several points to produce a non-uniformity map. An image signal with multiple regions of data is received. For each region, the angular position of the intentional variation in that region is determined, and the non-uniformity map is used to determine the correction required for the unintentional variation. The image data in the region are adjusted to compensate, and corresponding toner is deposited.

21 Claims, 8 Drawing Sheets

ELECTROPHOTOGRAPHIC NON-UNIFORMITY COMPENSATION USING INTENTIONAL PERIODIC VARIATION

FIELD OF THE INVENTION

This invention pertains to the field of electrophotographic printing and more particularly to measuring and compensating for non-uniformity in a printer.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g., clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g., of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

Various components, such as belts and drums, used in the electrophotographic process can have mechanical or electrical characteristics that result in periodic objectionable nonuniformities in print images, such as streaks (extending in-track) or bands (extending cross-track). For example, drums can experience runout: they can be elliptical rather than circular in cross-section, or mounted slightly off-center, so that the radius of the drum at a particular angle with the horizontal varies over time. Belts can have thicknesses that vary across their widths (cross-track) or along their lengths (in-track). Damped springs for mounting components can experience periodic vibrations, causing the spacing between the mounted components to change over time. These variations are generally periodic in nature, that is, each variation cycles through various magnitudes repeatedly in sequence, at a characteristic and generally fixed frequency.

Various schemes have been proposed for correcting the nonuniformities resulting from these mechanical variations. U.S. Pat. No. 7,058,325 to Hamby et al. deposits a test patch, measures its density, and corrects using a feedback or feed-forward control routine. U.S. Patent Publication No. 2008/0226361 by Tomita et al. describes measuring multiple patterns, each containing multiple rows of toner, possibly set at different angles on the page, and combining the measurement results to determine image adjustments. U.S. Pat. No. 7,755,799 to Paul et al. also measures test patches, and uses a defect once-around signal to synchronize the measurements to the rotation of the drum. The once-around signal is derived from an optical sensor monitoring the drum's position. Paul describes that the phase of a periodic banding defect (a non-uniformity extending cross-track) is difficult to measure because, unlike frequency, it varies from page to page.

The various schemes discussed above require additional sensors or calculations on low-amplitude, noisy data to determine the phase of banding defects and other periodic nonuniformities. Moreover, multiple components in a printer can have individual nonuniformities, which interact with each other. This results in significant noise in measured density data. There is an ongoing need, therefore, for an improved way of characterizing the periodic nonuniformities in an electrophotographic printer.

SUMMARY OF THE INVENTION

According to an aspect of the present invention, there is provided a method of compensating for non-uniformity in an electrophotographic printer, comprising:

providing the electrophotographic printer with a rotatable imaging component having an intentional periodic variation;

forming a test patch by depositing toner on a test surface using the rotatable imaging component, the test patch having a length;

measuring the respective densities of a plurality of points along the length of the test patch using a density sensor;

using a processor to automatically detect, using the measured densities, respective angular positions of the intentional periodic variation in the test patch and respective amounts of an unintentional periodic variation in the test patch at one or more of the plurality of points;

using the processor to automatically produce a non-uniformity map that relates the detected angular positions with the detected amounts at one or more of the plurality of points receiving an image signal representing a print image to be deposited on a receiver by the printer, the image signal including a plurality of regions arranged around the rotatable imaging component;

rotating the rotatable imaging component and, for each successive region in the image signal:

- determining a region angular position of the intentional variation in the region;
- using the produced non-uniformity map to determine a correction value corresponding to the determined region angular position;
- automatically adjusting the image data of the region with the correction value using the processor; and
- depositing toner corresponding to the adjusted image data of the region on the receiver using the rotatable imaging component.

According to another aspect of the present invention, there is provided a method of compensating for non-uniformity in an electrophotographic printer, comprising:

providing the electrophotographic printer with a rotatable photoreceptor having an intentional periodic variation;

forming a test target by image-wise charging the surface of the photoreceptor, the test target having a length;

measuring the respective potentials of a plurality of points along the length of the test target;

using a processor to automatically detect, using the measured potentials, respective angular positions of the intentional periodic variation in the test target and respective amounts of an unintentional periodic variation in the test target at one or more of the plurality of points;

using the processor to automatically produce a non-uniformity map that relates the detected angular positions with the detected amounts at one or more of the plurality of points;

receiving an image signal representing a print image to be deposited on a receiver by the printer, the image signal including a plurality of regions arranged around to the rotatable imaging component; and rotating the rotatable imaging component, and, for each successive region in the image signal:

determining a region angular position of the intentional variation in the region;

using the produced non-uniformity map to determine a correction value corresponding to the determined region angular position;

automatically adjusting the image data of the region with the correction value using the processor; and depositing toner corresponding to the adjusted image data of the region on the receiver using the rotatable imaging component.

An advantage of this invention is that it provides reliable measurement of, and correction for, unintentional variations without needing possibly-unreliable encoders. It also corrects for the intentional variations to provide a high-quality image. It can correct for variations in belts regardless of precession of the belts on their drive members. The measurements of the intentional variation can provide information about the phase and amount of the unintentional variation. This information can be used for system identification and diagnostics. Various embodiments do not require dedicated phase or once-around sensors or complex calculations. Various embodiments clearly identify the phase of the rotatable imaging component using a high magnitude for the intentional variation. This clearly differentiates error-causing components from each other. Another advantage of the invention is that it correlates sensor output to intentional variation, providing a measurement of the gain of the detection system that can be used to detect calibration drift of the sensor itself.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
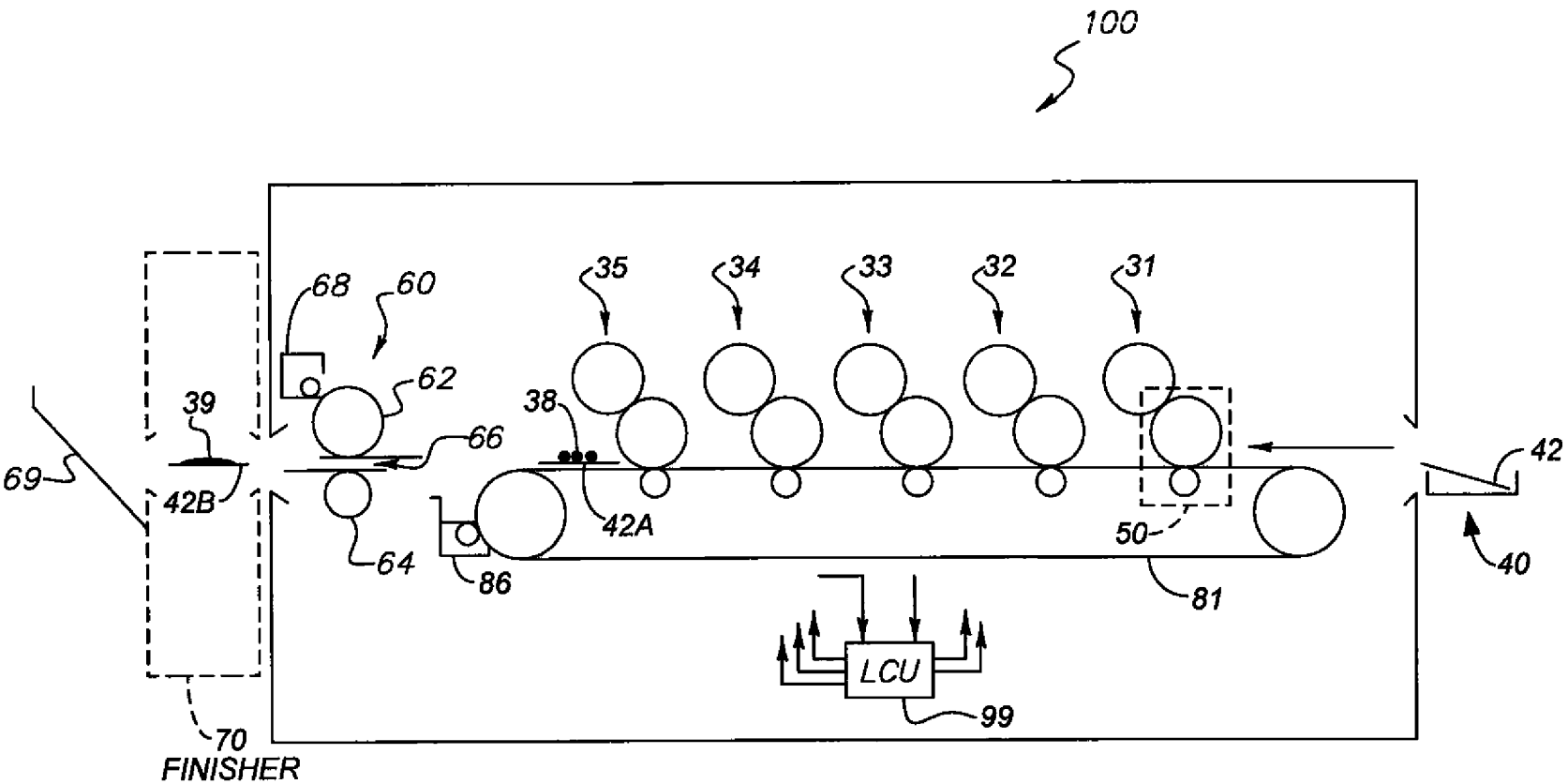
FIG. 1 is an elevational cross-section of an electrophotographic reproduction apparatus suitable for use with various embodiments.

The attached drawings are for purposes of illustration and are not necessarily to scale.

DETAILED DESCRIPTION OF THE INVENTION

As used herein, the terms "parallel" and "perpendicular" have a tolerance of ±10°.

In the following description, some embodiments will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, systems and methods described herein. Other aspects of such algorithms and systems, and hardware or software for producing and otherwise processing the image signals involved therewith, not specifically shown or described herein, are selected from such systems, algorithms, components, and elements known in the art. Given the systems and methods as described herein, software not specifically shown, suggested, or described herein that is useful for implementation of any embodiment is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method(s) according various embodiment(s).

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color onto a receiver. A printer can also produce selected patterns of toner on a receiver, which patterns (e.g., surface textures) do not correspond directly to a visible image. The DFE receives input electronic files (such as Postscript command files) composed of images from other input devices (e.g., a scanner, a digital camera). The DFE can include various function processors, e.g., a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g., the electrophotographic process) to provide known, consistent color reproduction characteristics. The color management system can also provide known color reproduction for different inputs (e.g., digital camera images or film images).

In an embodiment of an electrophotographic modular printing machine useful with various embodiments, e.g., the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g., dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
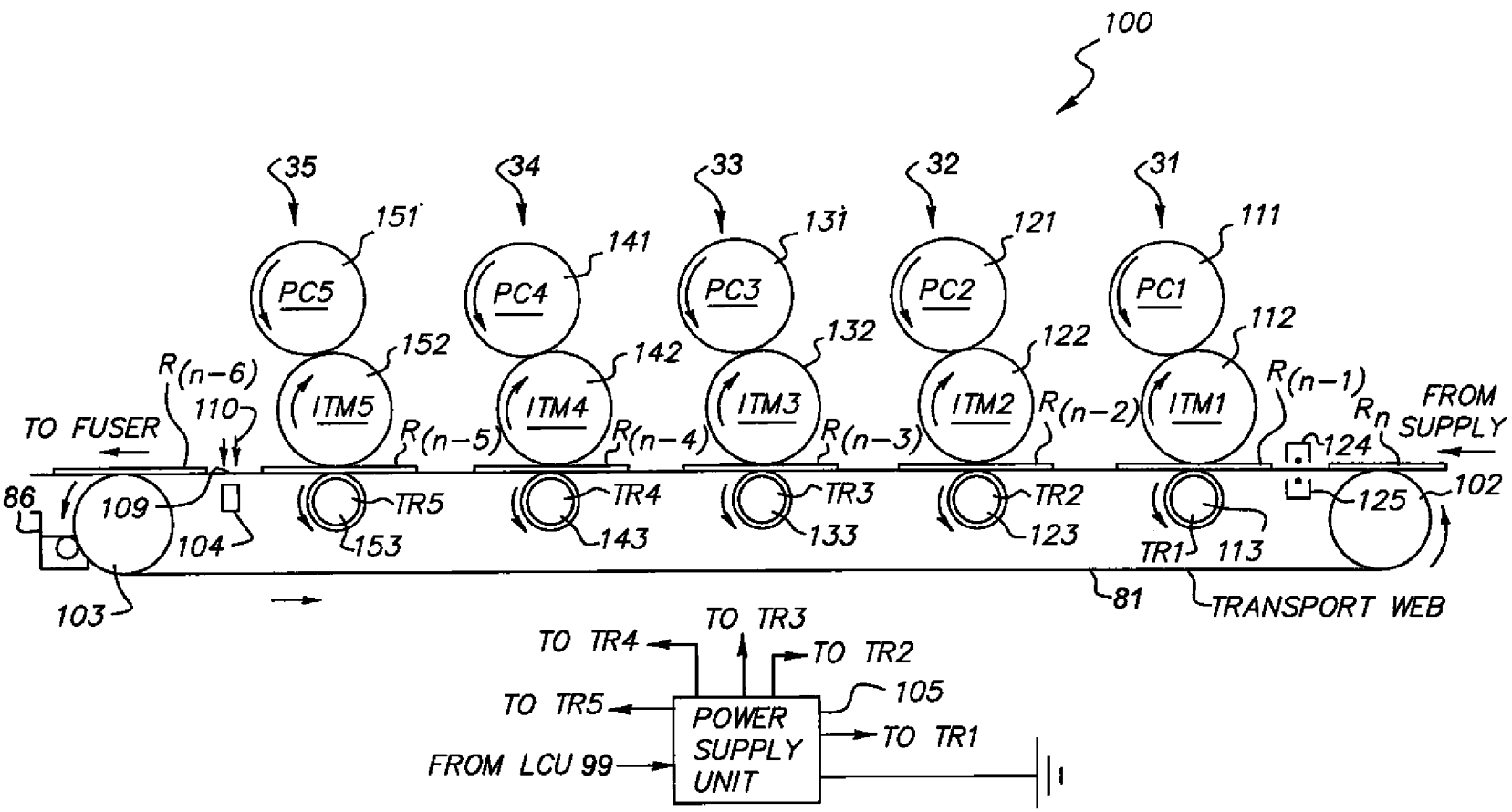
FIG. 2 is an elevational cross-section of the reprographic image-producing portion of the apparatus of FIG. 1.
Figure 3:
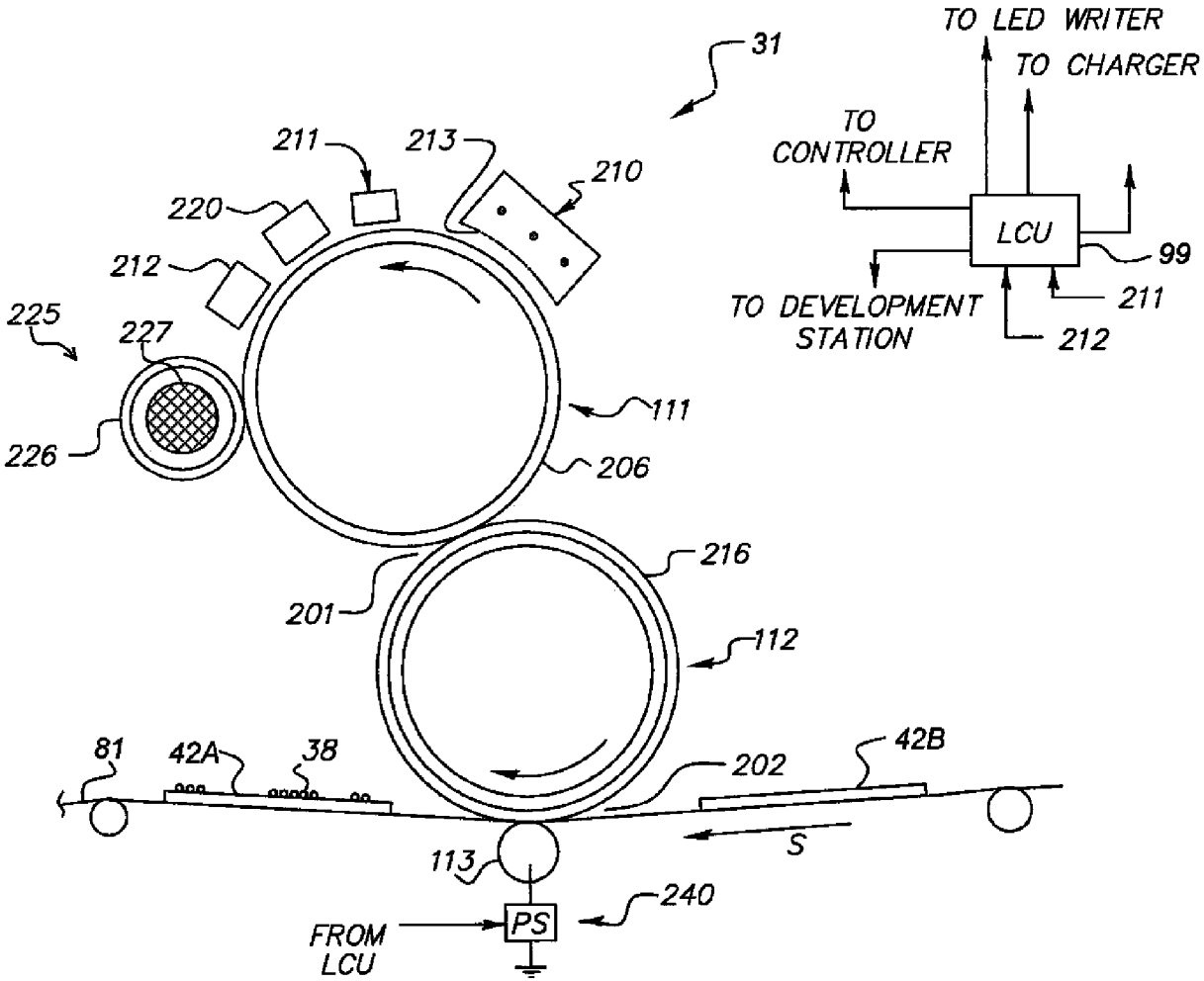
FIG. 3 is an elevational cross-section of one printing module of the apparatus of FIG. 1.

FIGS. 1-3 are elevational cross-sections showing portions of a typical electrophotographic printer 100 useful with various embodiments. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g., silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of the respective LED writers, e.g., for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g., color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Referring to FIG. 2, receivers $R_n$-$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member (111, 121, 131, 141, 151), e.g., a roller or belt, an intermediate transfer member (112, 122, 132, 142, 152), e.g., a blanket roller, and transfer backup member (113, 123, 133, 143, 153), e.g., a roller, belt or rod. Thus in printing module 31, a print image (e.g., a black separation image) is created on imaging member PC1 (111), transferred to intermediate transfer member ITM1 (112), and transferred again to receiver $R_{(n-1)}$ moving through transfer subsystem 50 (FIG. 1) that includes transfer member ITM1 (112) forming a pressure nip with a transfer backup member TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer members (112, 122, 132, 142, 152), is the fast-scan direction.

A receiver, $R_n$, arriving from supply unit 40 (FIG. 1), is shown passing over roller 102 for subsequent entry into the transfer subsystem 50 (FIG. 1) of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup members 113, 123, 133, 143, and 153. LCU 99 (FIG. 1) provides timing and control signals to the components of printer 100 in response to signals from sensors in printer 100 to control the components and process control parameters of the printer 100. A cleaning station 86 for transport web 81 permits continued reuse of transport web 81. A densitometer array includes a transmission densitometer 104 using a light beam 110. The densitometer array measures optical densities of five toner control patches transferred to an interframe area 109 located on transport web 81, such that one or more signals are transmitted from the densitometer array to a computer or other controller (not shown) with corresponding signals sent from the computer to power supply 105. Transmission densitometer 104 is preferably located between printing module 35 and roller 103. Reflection densitometers, and more or fewer test patches, can also be used.

FIG. 3 shows more details of printing module 31, which is representative of printing modules 32, 33, 34, and 35 (FIG. 1). Primary charging subsystem 210 uniformly electrostatically charges photoreceptor 206 of imaging member 111, shown in the form of an imaging cylinder. Charging subsystem 210 includes a grid 213 having a selected voltage. Additional components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g., laser or LED writers), and the respective development station 225 of each printing module 31, 32, 33, 34, 35 (FIG. 1), among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g., of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 (FIG. 1) which the light source (e.g., laser or LED) can expose with a selected exposure different from the exposure of another engine pixel. Engine pixels can overlap, e.g., to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g., a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Pat. No. 6,728,503 to Stelter et al., issued Apr. 27, 2004, the disclosures of which are incorporated herein by reference. Development station 225 can also employ a mono-component developer comprising toner, either magnetic or non-magnetic, without separate magnetic carrier particles.

Transfer subsystem 50 (FIG. 1) includes transfer backup member 113, and intermediate transfer member 112 for transferring the respective print, image from photoreceptor 206 of imaging member 111 through a first transfer nip 201 to surface 216 of intermediate transfer member 112, and thence to a receiver (e.g., 42B) which receives the respective toned print images 38 from each printing module in superposition to form a composite image thereon. Print image 38 is e.g., a separation of one color, such as cyan. Receivers are transported by transport web 81. Transfer to a receiver is effected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

As described above, electrophotographic printers contain many rotatable imaging components, such as drums or belts. The angular position of a component is the percentage of a full revolution or cycle of an index point on the component with respect to a home position, expressed in degrees (100%=360°). For example, for a drum, each quarter-turn rotation increases or decreases the angular position of the drum by 90°. Similarly, for a belt, as the index point moves halfway along the belt from the home position, the angular position of the belt increases or decreases from 0° to 180°. The index point and the home position do not have to be marked, or be any physical structure. They can be defined electronically using encoders.

Figure 8:
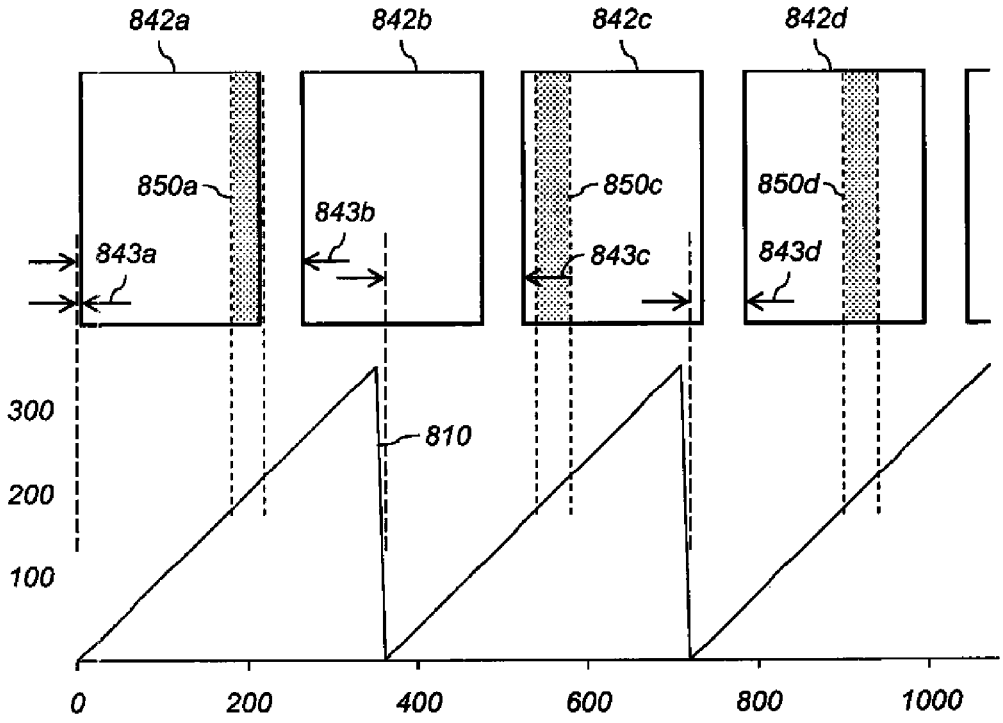
FIG. 8 is a chart showing varying phase of defects on printed pages.

FIG. 8 is a chart showing varying phase of defects on printed pages. The abscissa is angular position of a rotatable imaging component, unwrapped (i.e., not modulo 360), in degrees. The ordinate is angular position, wrapped (modulo 360°). As shown by curve 810, the component rotates from 0° to 339°, then back around to 0°. In this example, the component has a defect from 180° to 220° of angular position, indicated by the dashed lines. In defect areas 850*a*, 850*c*, 850*d*, the image is printed with higher density than expected, as indicated by the shading. Receivers 842*a*, 842*b*, 842*c*, 842*d* are being printed on. Each receiver extends across 210° of angular position, with a 50° gap between receivers. Since 260° does not evenly divide 360°, each receiver has a different phase: each receiver begins at a different angular position of the component. As used herein, "phase" refers to the angular position (0°-360°) of a rotatable imaging component with respect to a reference on the receiver being printed (e.g., the leading edge of the receiver) during a printing step. In this example, receiver 842*a* has phase 843*a* of 5°, receiver 842*b* has phase 843*b* of 265°, receiver 842*c* has phase 843*c* of 165°, and receiver 842*d* has phase 843*d* of 65°. If the ratio of receiver pitch (here, 260°) to 360° is rational, the sequence of phases will eventually repeat.

Since each receiver has a different phase, defect areas occur at different positions on each receiver. In this example, receiver 842*a* has defect area 850*a* near its trailing edge. Receiver 842*b* has no defect area. Receiver 842*c* has defect area 850*c* near its leading edge. Receiver 842*d* has defect area 842*d* in its middle.

According to various embodiments, non-uniformity of a rotatable electrophotographic imaging component is compensated. The component has an intentional periodic variation that produces density variations in a test target, or potential variations on the photoreceptor. First, the characteristics of the intentional and unintentional variations are measured and optionally separated from each other, preferably without any compensation being applied during the measurement period. The angular position of the intentional variation is correlated with the amount of an unintentional variation at one or more test points. Second, the correlation is used to print a compensated image. An image signal with multiple regions of data is received. For each region, an angular position of the intentional variation in that region is determined, and the correlation is used to determine the correction required for the unintentional variation. The image data in the region are adjusted to compensate, and corresponding toner is deposited. This provides a print image that corresponds to the image signal and that does not exhibit visible non-uniformities, or other artifacts, that are due to the unintentional variations. Compensation is discussed below. Various embodiments described herein can be used together with compensation for other sources of artifacts in a printer that experience periodic variations.

As used herein, "amount of a variation" and similar terms mean the size or quantity of a variation with respect to a selected reference. For example, the amount of a variation at a given point or in a given sample area in a test patch with an aim density of 2.0 can be the difference between 2.0 and the actual density printed at that point or in that sample area. If the sample area is darker, e.g., density=2.5, the amount of variation is 0.5. If the sample area is lighter, e.g., density=1.5, the amount of variation is −0.5.

Figure 9A:
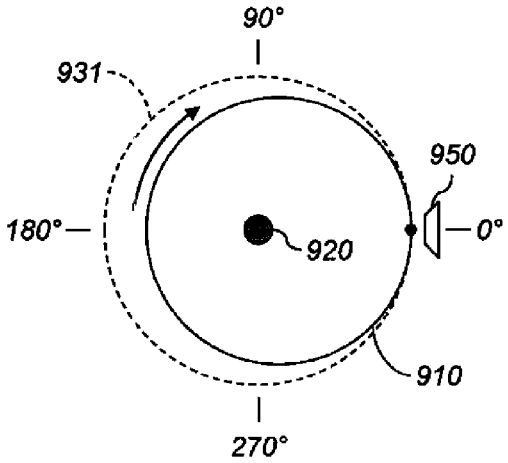
FIGS. 9A-11B show various embodiments of rotatable imaging components with periodic variations.
Figure 10A:
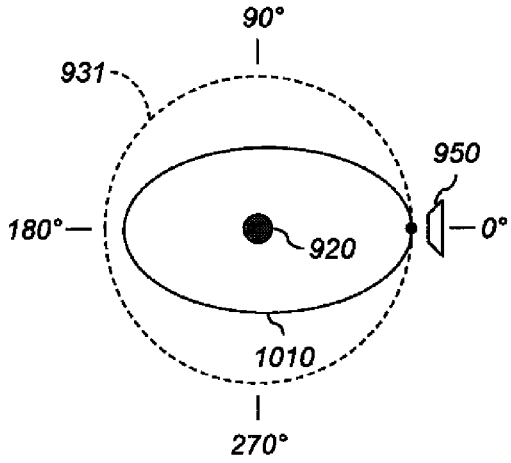
Figure 9B:
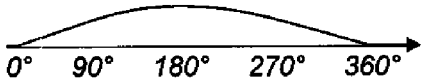
Figure 10B:
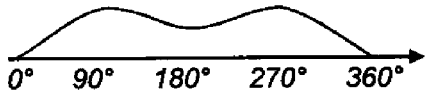
Figure 11A:
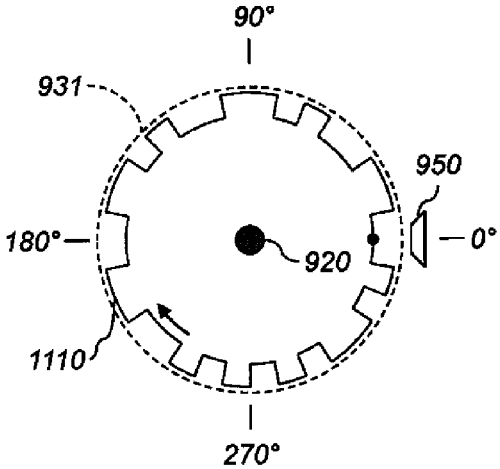
Figure 11B:
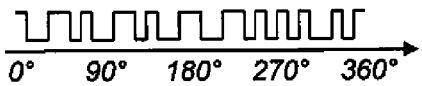

FIGS. 9A-11B show various embodiments of rotatable imaging components with periodic variations. FIGS. 9A, 10A, 11A are cross-sections of drums with periodic variations. FIGS. 9B, 10B, 11B are the corresponding profiles of difference from a circle as, a function of angular position. The abscissas of FIGS. 9B, 10B, 11B are angular position as the drum rotates clockwise with respect to sensor 950 held fixed at the 0° position indicated. That is, as the drum rotates clockwise, the 90° position of the drum passes sensor 950, then the 180° and the 270°, then back to the 0° position.

In FIG. 9A, drum 910 is circular and is mounted on axle 920. Axle 920 is off-center on drum 910 so that, as drum 910 rotates, the spacing between its surface and another member adjacent to it varies. Circle 931 is shown for comparison. FIG. 9B shows the spacing varying as a function of angle: the spacing is smallest at 0° and largest at 180°, with a period of 360° (frequency 1/revolution).

In FIG. 10A, drum 1010 is circular and is mounted off-center on axle 920. FIG. 10B shows the corresponding spacing: smallest at 0° and largest at 90° and 270°, with an intervening dip at 180°. The period is 360° (freq. 1/rev.), but the frequency is higher. In other embodiments, an elliptical drum mounted on-center is used, so the period is 180° (freq. 2/revolution). Circle 931 and sensor 950 are as shown in FIG. 9A.

In FIG. 11A, drum 1110 has a pattern of ridges and dips providing a Manchester-coded bit stream in the spacing as the drum rotates. The period is 360°. FIG. 11B shows the resulting distances, which correspond to an IEEE 802.3-Manchester-encoded bit stream of 0100 1001 0100 0011. A 0 is represented by a high-to-low transition in FIG. 11B (a dip-to-ridge transition in FIG. 11A) and a 1 by a low-to-high transition in FIG. 11B (a ridge-to-dip transition in FIG. 11A). Circle 931 and sensor 950 are as shown in FIG. 9A.

Figure 4:
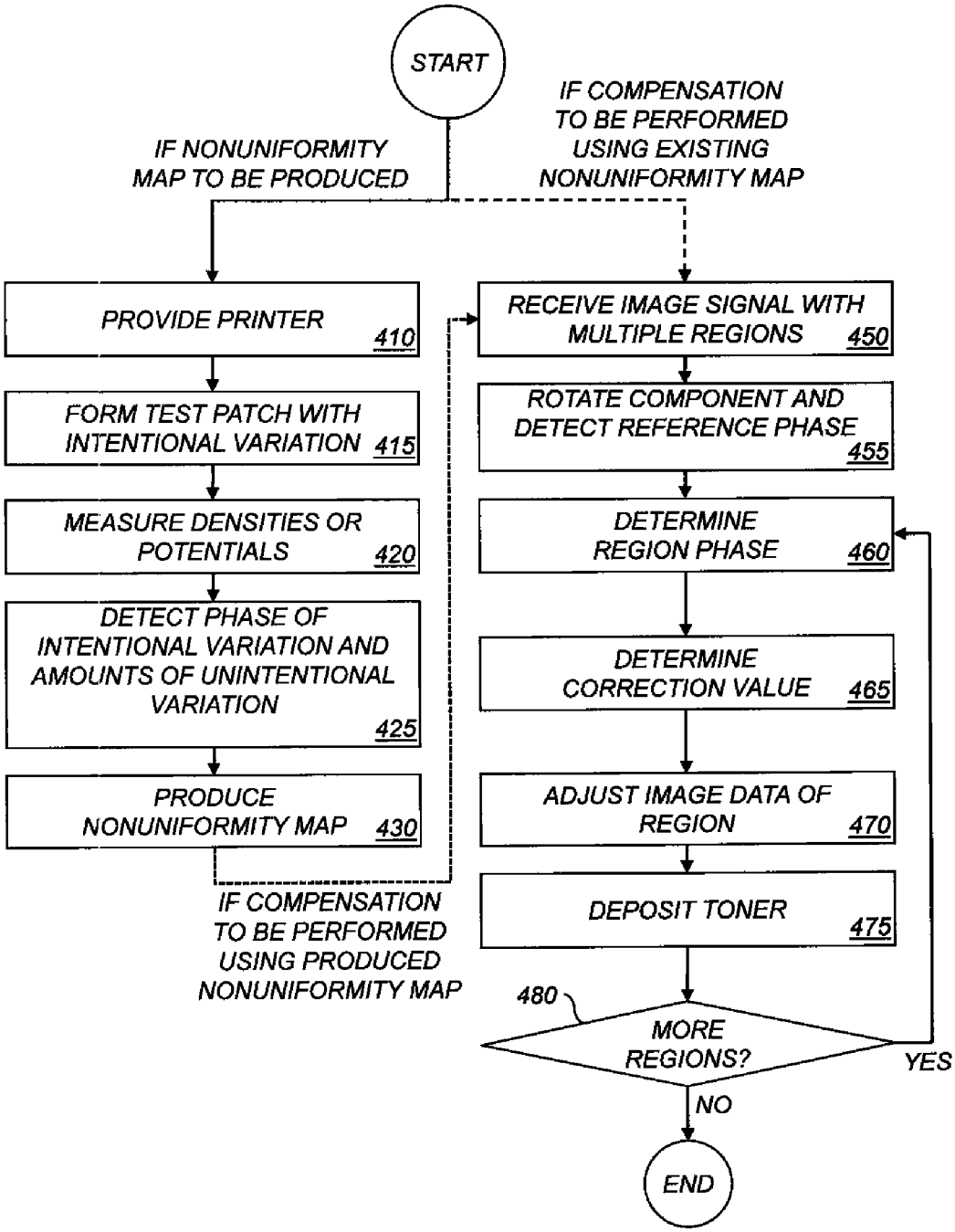
FIG. 4 is a flowchart of methods of producing a non-uniformity map of an electrophotographic printer and of compensating for non-uniformity in an electrophotographic printer according to various embodiments.

FIG. 4 is a flowchart of methods of producing a non-uniformity map of an electrophotographic printer and of compensating for non-uniformity in an electrophotographic printer according to various embodiments. Steps 410-430 are the first process described above: measuring the characteristics of the variations to produce a non-uniformity map. Steps 450-480 are the second process: compensating an image signal to provide a print image. If the non-uniformity map is to be produced, processing begins with step 410. If compensation is to be performed using an existing non-uniformity map, processing begins with step 450.

In step 410, the electrophotographic printer is provided (e.g., printer 100, FIG. 1). The printer has a rotatable imaging component (e.g., photoreceptor 206, FIG. 3) having an intentional periodic variation. Rotatable imaging components can include drums or cylinders, belts or webs, galvo-mounted mirrors such as raster optical scanners (ROS), or other rotating or rotatable components. Intentional periodic variations can be provided in various ways. For example, a drum can be elliptical rather than circular in cross-section (eccentricity in the open interval (0, 1)). It can be mounted off-center, i.e., the axle can be non-concentric with the drum. Either of these can produce runout, a variation in the distance from the axle to the surface of the imaging component as the imaging component rotates. For belts, the thickness can be varied periodically along the length of the belt. Drive systems for the imaging component can be designed to produce controlled, periodic drive chatter. Drive systems can also be programmed or designed to vary the velocity periodically, e.g., as a sinusoid about an average. Mechanical weights can be attached to the imaging component to cause known vibrations. The spacing between the imaging component and a neighboring component can also be varied periodically; as used herein, this is considered an intentional periodic variation of the imaging component, and the neighboring component is considered to be a fixed reference. Step 410 is followed by step 415.

In step 415, a test patch is formed by depositing toner on a test surface using the rotatable imaging component. In various embodiments, the test surface is a receiver, an intermediate web or drum, or a photoreceptor. Other components can be used in forming the test patch.

In one example, referring back to FIG. 3, the rotatable imaging component is toning shell 226 and the test surface is receiver 42A. The printer is further provided with a second imaging component, e.g., photoreceptor 206 or intermediate transfer member 112. The second imaging component is also involved in depositing the toner on the test patch using the imaging component. Specifically, toner is transferred from the rotatable imaging component (toning shell 226) to the second imaging component (photoreceptor 206), and then from the second imaging component to the test surface (receiver 42A), here via intermediate transfer member 112. In other embodiments, toner is transferred directly from photoreceptor 206 to receiver 42A. However it is deposited, the test patch has a length in-track. Referring back to FIG. 4, step 415 is followed by step 420.

In step 420, the respective densities of a plurality of points along the length of the test patch are measured using a density sensor, such as a CCD or densitometer. Other points, or multiple points at the same in-track location along the length of the test patch, can be measured. Some or all of the measured points can be used for determining the non-uniformity map, discussed below. The test patch can be measured before or after fusing. Measuring before fusing can reduce interference among effects; measuring after fusing can provide density data more representative of the user's view of the print. Step 420 is followed by step 425.

The measured densities of the plurality of points together compose a density signal. In embodiments in which the test patch is intended to represent a constant density over its area, the density signal exhibits variations due to the combined effect of the intentional variation and the unintentional variation. A processor is used to separate the intentional and unintentional variations. The unintentional variations are then correlated to the angular positions of the intentional variation. When printing, the correlation is used to determine the appropriate correction for the unintentional variation. The angular position of the intentional variation is detected to permit the processor to infer the error in the image due to the unintentional variation at a certain phase with respect to the intentional variation.

Specifically, in step 425, a processor (e.g., LCU 99, FIG. 1) is used to automatically detect the respective angular positions of the intentional periodic variation in the test patch using one or more of the measured density points. This is discussed further below with reference to FIG. 6.

In various embodiments, the processor detects the phase of the intentional variation by performing a Fourier transform of the measured density data and selecting the resulting computed phase corresponding to a known frequency of the intentional variation. In other embodiments, the processor detects data values above or below selected power thresholds in the Fourier-transformed data. In an example, the intentional variation is a sinusoid with a period of 360° of rotation of the imaging component. The highest signal level measured at a consistent angle of rotation over several revolutions of the imaging component is determined to be the peak of the waveform, and is assigned a selected phase, e.g., 0°. The phase of any other point on the component is thus the phase of the peak plus the difference in angle of rotation between the peak and the point.

To detect the angular position of the intentional variation, the detected phase can be multiplied by the rotational frequency of the component to provide a mapping between elapsed time since the measurement was taken and angular position. Elapsed time since a peak was detected can be divided by rotational frequency to determine angular position.

The processor also detects the respective amounts of at least one unintentional periodic variation in the test patch at one or more of the plurality of points. In various embodiments, the intentional-variation components of the FFT of the measured signal are removed from the FFT. An inverse FFT is then performed to reconstruct the signal representing only the unintentional variation. The reconstructed signal is sampled at the angles of rotation corresponding to the desired points to determine the amounts of variation. It is not required that the data for all points measured be used to detect phase, or that amounts of variation be detected at all points measured. Step 425 is followed by step 430.

In various embodiments, the processor can include, or communicate with, a phase-locked loop (PLL). The PLL can be locked to the phase and frequency of the rotatable imaging component. In an example, the measured data points are applied as they are measured to a Schmitt-triggered buffer whose output synchronizes the PLL. The processor can use the phase of the PLL as a representation of the intentional periodic variation, and therefore detect the phase of the variation by reading the phase of the PLL.

In step 430, the processor is used to automatically produce a non-uniformity map by correlating the detected respective angular positions with the respective detected amounts at one or more of the plurality of points. The non-uniformity map therefore relates detected angular positions of the intentional periodic variation to corresponding amounts of the unintentional variation at the corresponding angular positions of one or more of the plurality of points. This is described further with respect to FIG. 6, below. In various embodiments, the non-uniformity map further relates the detected angular position of the intentional variation to the amount of intentional variation. The non-uniformity map can be implemented as a look-up table or a function. The processor can interpolate, average, smooth, filter, or transform measured data points to produce the non-uniformity map.

At the conclusion of step 430, the non-uniformity map has been provided. If compensation is to be performed using the produced non-uniformity map, step 430 is followed by step 450.

Step 450 begins the compensation using a produced non-uniformity map, whether just-produced or previous-produced and stored in, and retrieved from, a memory. In step 450, an image signal representing a print image to be deposited on a receiver by the printer is received. The image signal includes a plurality of regions arranged around the rotatable imaging component. In various embodiments, a region is a row of the image extending in the cross-track direction, or a group of contiguous rows, or a group of multiple rows, some contiguous and others not, or forming multiple non-contiguous groups of contiguous rows. Step 450 is followed by step 455.

In step 455, the rotatable imaging component is rotated and a reference phase of the intentional periodic variation is detected. The reference phase corresponds to a selected reference point in the image signal. The phase can be detected by using the sensors described above for measuring the phase, or with other sensors or PLLs. For example, a low-resolution density sensor with a Schmitt-triggered output buffer can provide a signal indicating when density has exceeded a selected level. An electrometer can also be used to measure the potential of the latent image on the photoreceptor, or a densitometer can be used to measure a continuous test strip of a selected density (before variations). Any of the above can be combined with a PLL. Step 455 is followed by steps 460-480, which are repeated for each successive region in the image signal.

In step 460, a region phase of the intentional periodic variation is determined using the reference phase. The region phase corresponds to the region being processed; for example, each row of the image has a successively-incrementing phase. In an embodiment, the region phase is the reference phase plus the angular motion of the imaging component since the reference phase was detected. Angular motion can be measured directly, e.g., with an encoder, or indirectly by multiplying the elapsed time of rotation and the average angular velocity. Step 460 is followed by step 465.

In step 465, the produced non-uniformity map is used to determine a correction value corresponding to the determined region phase. The correction value indicates how the image data for the region should be adjusted to compensate for the unintentional variation. In various embodiments, the produced non-uniformity map is also used to determine a correction value appropriate for adjusting the image data to compensate for the intentional variation. Specifically, in these embodiments the processor produces the non-uniformity map so that the non-uniformity map relates the detected phase of the intentional periodic variation to the respective amounts of unintentional variation and also to the amounts of intentional variation. Step 465 is followed by step 470.

In step 470, the image data of the region are automatically adjusted with the correction value using the processor. The correction values can be applied by adding, multiplying, or applying a matrix transform (linear or nonlinear). The correction values can be applied to each pixel of the image, blocks of the image, or the whole region. Step 470 is followed by step 475.

In step 475, toner corresponding to the adjusted image data of the region is deposited on the receiver using the rotatable imaging component. In various embodiments, such as that described above using the toning shell and the receiver, other printer components are also used in depositing the toner. Step 475 is followed by decision step 480. Decision step 480 determines whether there are more regions to be printed. If not, printing is complete. If so, the next step is step 460.

Figure 12:
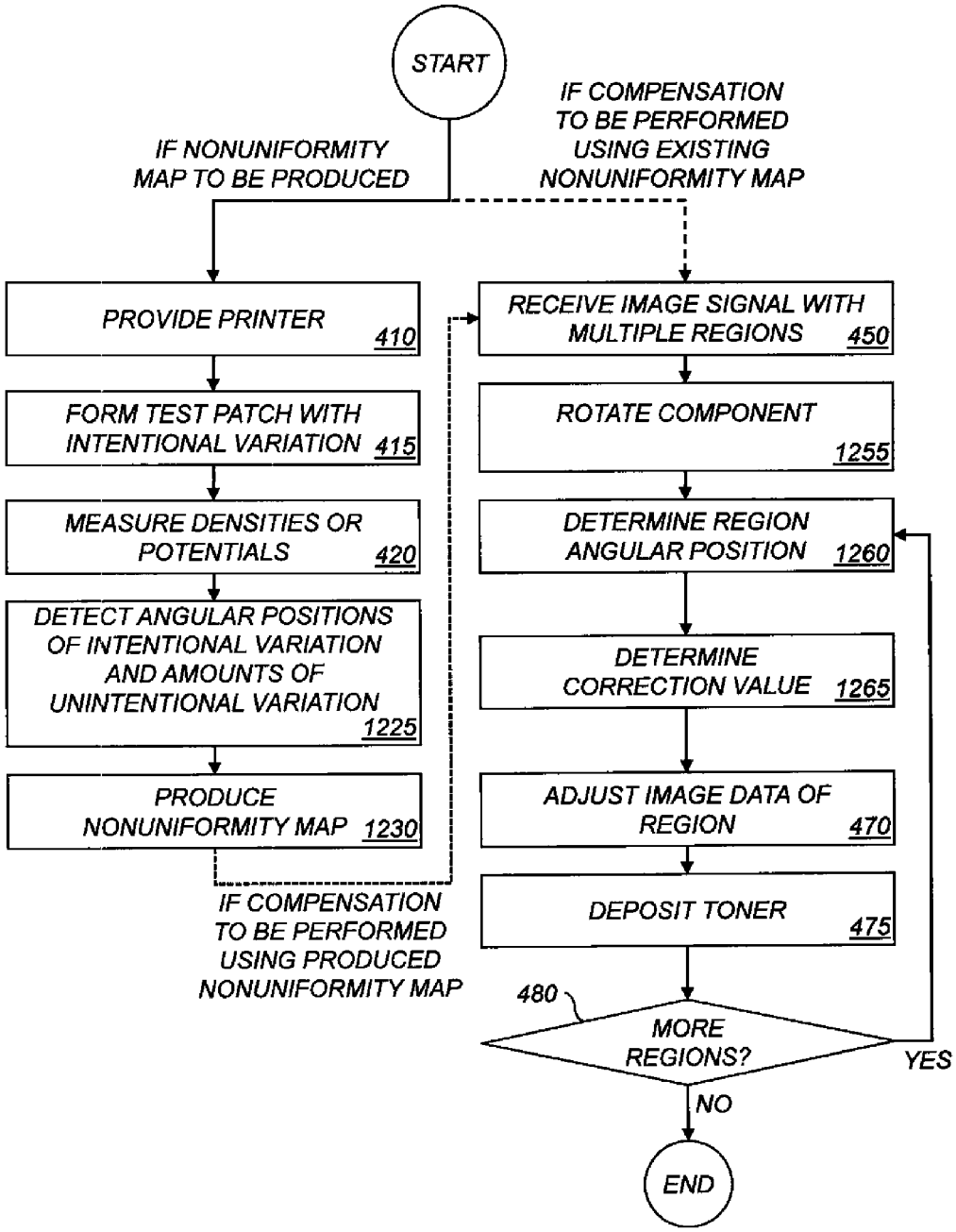
FIG. 12 is a flowchart of methods of producing a non-uniformity map of an electrophotographic printer and of compensating for non-uniformity in an electrophotographic printer according to various embodiments.

FIG. 12 is a flowchart of methods of producing a non-uniformity map of an electrophotographic printer and of compensating for non-uniformity in an electrophotographic printer according to various embodiments. Steps 410, 415, 420, 450, 470, 475 and 480 are as shown in FIG. 4.

In step 1225, the processor automatically detects, using the measured potentials, respective angular positions of the intentional periodic variation in the test target and respective amounts of an unintentional periodic variation in the test target at one or more of the plurality of points. The processor directly detects the angular position of the intentional variation, and hence of the rotatable component. This is in contrast to other embodiments, in which the processor determines the phase of the intentional variation, which is the angular position of the intentional variation with respect to the beginning of the next print image to be deposited, as discussed above with respect to FIG. 8. Step 1225 is followed by step 1230.

In step 1230, the processor is used to automatically produce a non-uniformity map that relates the detected angular positions with the detected amounts at one or more of the plurality of points. Step 1230 is optionally followed by step 450, as discussed above.

Step 450, receiving the image signal, is followed by step 1255. In step 1255, the rotatable imaging component is rotated. Steps 1260, 1265, 470, and 475 are performed for each successive region in the image signal, in a selected order, e.g., the order of occurrence on the component.

In step 1260, a region angular position of the intentional variation in the region under consideration is determined. This is the angular position of the intentional variation most representative of the image data in this region. For small (e.g., single-line) regions, a single angular position can be selected. For larger regions, the angular position of the center or toner-mass centroid of the region can be used, or that of the leading or the trailing edge of the region, or another position a selected percentage of the way or selected distance across the region. Step 1260 is followed by step 1265.

In step 1265, the produced non-uniformity map is used to determine a correction value corresponding to the determined region angular position. The correction value is then used to adjust the image data of the region in step 470, as described above with respect to FIG. 4.

Figure 6:
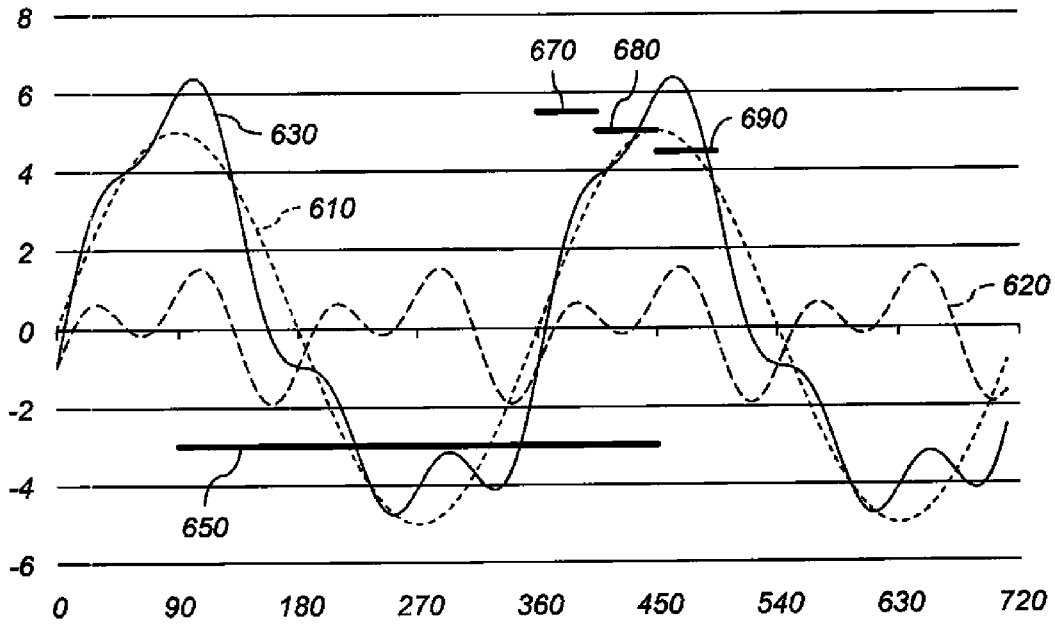
FIG. 6 shows a simulation of measured data and of phases of a test patch and image data.

FIG. 6 shows a simulation of measured data and of phases of a test patch and image data. Curve 610 shows simulated data for the intentional variation. Curve 620 shows simulated data for the unintentional variation. Curve 630 is a simulation of the measured data, the sum of curves 610 and 620. The abscissa is angular position of the rotatable imaging component in degrees, and the ordinate is the measured signal (e.g., toner density or photoconductor potential) in arbitrary units. The abscissa is measured with respect to a selected zero point on the surface of the rotatable imaging component (belt or drum), so that 360° of angular travel of the component return it to the same position it was before the travel. Angular positions are therefore treated modulo 360°; two cycles are shown as 0°-720° in this figure for clarity. Since the intentional variation is fixed on the rotatable imaging component, this chart shows measured signal, including the amounts of both intentional and unintentional variation, as a function of angular position of the intentional variation, as discussed above with reference to FIG. 4 step 425.

In this example, curve 610 is defined as $$f_{610}(\theta)=5\sin(\theta)$$

for each angle θ on [0°, 710°]. Curve 620 is defined as $$f_{620}(\theta)=\sin(4\theta)+\cos(2\theta+60°).$$

The average of the absolute values of curve 610 at the simulated points is 3.17. The corresponding average for curve 620 is 0.81. Therefore the average amount of variation of curve 610 is approximately 3.9× the average amount of variation of curve 620, i.e., the average amount of unintentional variation (curve 620) is smaller than the average amount of intentional variation (curve 610). The frequency of curve 610 is readily visible in curve 630. Curve 620 can be extracted from curve 610 by Fourier-transforming it, removing the frequency components of curve 610, and inverse Fourier-transforming the result to reconstitute curve 620. In various embodiments, the intentional variation is a pure sinusoid having exactly one frequency term at a selected frequency, and optionally a DC term. This permits ready removal of curve 610 from curve 630 to extract curve 620. However, even if the intentional variation is not a pure sinusoid, and even if it is truncated at 360° (e.g., if curve 610 were 5 sin(0.75θ), so its period was 480° and it was truncated at 360°), it can still be extracted from the measured data and used to determine phase. The intentional variation is known by the processor, e.g., by being programmed in to a non-volatile memory communicatively connected to the processor. This memory holds a model of the signal of the intentional variation that the processor compares to the data values or FFT results to extract the intentional variation from the measured signal.

Marker 650 shows the angular range over which the test patch is produced. Measured points therefore fall between 90° and 450°, i.e., between 90° and 360°, and then between 0° and 90° due to wraparound. This is a full rotation of the rotatable imaging component. In various embodiments, the length of the test patch is selected to extend over 360° of the rotation of the imaging component, <360°, >360°, or ≥360°. Measuring a test patch (or combination of test patches) covering ≥360° provides data about the entire rotatable imaging component. In this example, the detected phase of the intentional periodic variation in the test patch is 90°, the angular position of the start of the test patch.

Markers 670, 680, and 690 show the angular extent of three regions of the image data. The first region extends from 360° to 405° (0° to 45°), the second from 405° to 450° (45° to 90°), and the third from 450° to 495° (90° to 135°). In this example, the first region is the beginning of the image data to be printed. Therefore, the reference phase is 0°, the angular position of the beginning of marker 670. The region phase of the first region is thus also 0°. The region phase of the second region, marker 680, is 45°. The region phase of the third region, marker 690, is 90°.

In various embodiments, the rotatable imaging component is toning shell 226 (FIG. 3) or another toning member. Each region of the image data can subtend ≤22.5° of an imaging component to provide effective compensation for the variations in that region.

In various embodiments, the average amount of unintentional variation is smaller than the average amount of intentional variation. Therefore, the processor can readily identify the intentional variation in the measured data. The average amount of unintentional variation can be smaller than the average amount of intentional variation, <50% thereof, <25% thereof, <10% thereof, or <1% thereof. The average can be taken over one cycle or multiple cycles.

In other embodiments, the intentional and unintentional variations are differentiated by pattern. Specifically, the intentional variation has a selected pattern that can be distinguished from the unintentional variation. In an embodiment, the intentional variation has a spatial frequency higher than a selected threshold spatial frequency, e.g., >5 or >10 peaks per cycle.

In these embodiments, the expected unintentional variation is measured or otherwise determined empirically before production of a printer begins. A highest-frequency significant component of the unintentional variation is determined by taking the Fourier transform of the measured unintentional-variation data and selecting the highest-frequency component with a power>−20 dB or >−10 dB with respect to the signal power of the total measured signal. The threshold spatial frequency can then be selected to be higher than, or higher than twice, the frequency of the determined highest-frequency significant component of the unintentional variation.

Providing the intentional variation with a spatial frequency above the selected threshold spatial variation permits reliably distinguishing the intentional from the unintentional variation, even when the two have substantially the same amplitudes. In one example, the intentional variation includes ten peaks spaced evenly around the rotatable imaging component. The processor locates the recurring pattern at a rate of approximately ten times the rotation frequency of the rotatable imaging component, and arbitrarily chooses one of the ten peaks to identify as the 0° point. As long as the printer continues to operate, or as long as the processor maintains information in a memory about the current phase (determined by counting the peaks as they pass), the phase of the rotatable imaging component will be known and can be correlated to the unintentional variation, as described above.

In another embodiment, the intentional variation includes a pseudo-random binary or multi-level sequence that can be detected to determine the phase of the intentional variation. A Costas or other delay-locked loop can be used to lock on to the pseudo-random sequence, and the phase of the sequence (and thus of the rotatable imaging component and the intentional variation) can be recovered from the loop. Related lock-on mechanisms are used in GPS receivers, e.g., those described in U.S. Pat. No. 4,578,678 to Hurd and U.S. Pat. No. 7,855,679 to Braiman, the disclosures of both of which are incorporated herein by reference.

In an example, the intentional variation includes a group of four rapid peaks at 0°, 15°, 30', and 45° phase of the rotatable imaging component, and three more peaks at 90°, 180°, and 270°, respectively. Provided this pattern has been determined not to be representative of unintentional variations, the controller can look for those seven peaks with those relative spacings to determine where the 0° point of the rotatable imaging component is (at the first peak in the rapid-peak group). This determination can be made even in the absence of a significant amplitude difference between intentional and unintentional variations In various embodiments, the intentional variation is a signal with period 360° of rotation of the imaging component, but without a sinusoidal component (other than DC) having a period of greater than 20° of rotation. For example, the intentional variation can be a selected Manchester- or 8B10B-coded bit stream. The bit patterns of parts of the stream can include encoded information about the angular positions of those parts, providing finer tolerances on the measurement of angular position. In various embodiments, the difference between "1" bits and "0" bits in the pattern provides a difference in density that is visible to a density sensor, or that is visible to the human eye.

Figure 5:
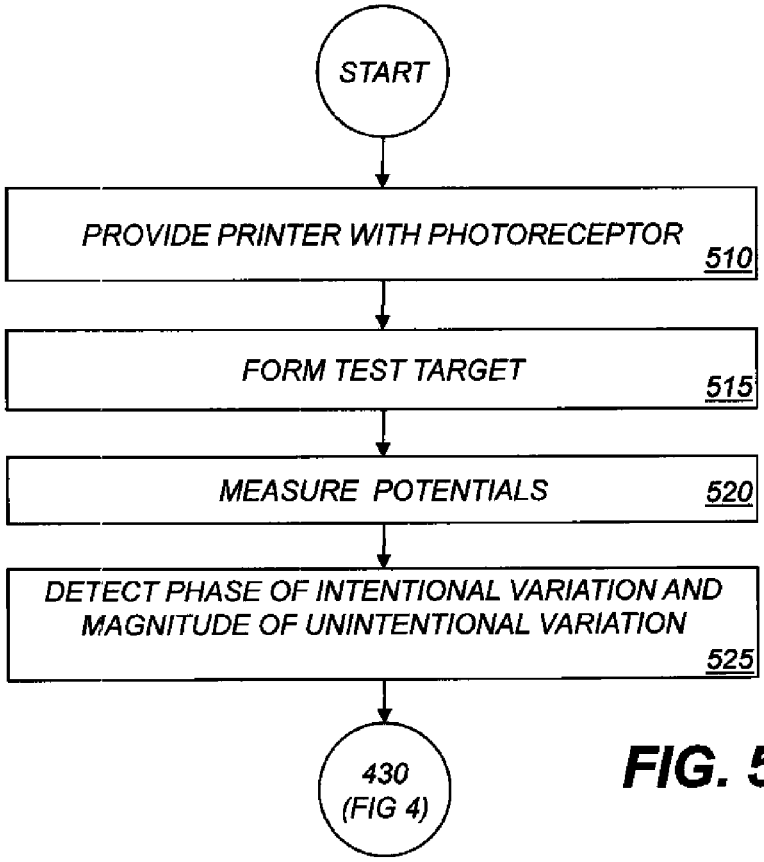
FIG. 5 is a partial flowchart of a method of compensating for non-uniformity in an electrophotographic printer according to various embodiments.

FIG. 5 shows a partial flowchart of a method of compensating for non-uniformity in an electrophotographic printer according to various embodiments. Processing begins with step 510.

In step 510, the electrophotographic printer is provided. The printer includes a rotatable photoreceptor having an intentional periodic variation, as described above. For example, the photoreceptor can be mounted with runout, or an elliptical photoreceptor can be used, e.g., as shown in FIGS. 9A-11B. Step 510 is followed by step 515.

In step 515, a test target is formed by image-wise charging the surface of the photoreceptor. The test target has a length, as described above. Step 515 is followed by step 520.

In step 520, the respective potentials of a plurality of points along the length of the test target are measured. An electrometer or other potential sensor can be used. Multiple points can be measured, as described above. Since the photoreceptor has an intentional periodic variation, the potentials vary with the intentional variation. For example, the intentional variation will bring the photoreceptor in and out of focus with an optical writer (exposure system 220 in FIG. 3). This will cause variations in the intensity and spread of each exposed area resulting in potentials that differ from the intended values. Similarly, any unintentional variations in the exposure, such as periodic variations in the drive power of a laser writer or nonuniformities in the surface of the photoreceptor, will cause variations in potential. Step 520 is followed by step 525.

In step 525, a processor is used to automatically detect the phase of the intentional periodic variation in the test target using one or more of the measured potentials. The processor also detects the amount of at least one unintentional periodic variation in the test target at one or more of the plurality of points, as described above. Also, as discussed above, in other embodiments the processor detects the angular positions of the intentional periodic variation at one or more points in the test target using one or more of the measured potentials. Step 525 is followed by step 430 (FIG. 4); the remainder of the printing process proceeds as described above.

In various embodiments, a non-uniformity map of an electrophotographic printer is produced using steps 410-430 shown in FIG. 4. In other embodiments, a non-uniformity map of an electrophotographic printer is produced using steps 510-525 shown in FIG. 5 together with step 430 shown in FIG. 4. In these embodiments, the produced non-uniformity map can be stored with the printer. The produced non-uniformity map can be compared to a second non-uniformity map produced at a later time to determine if the printer needs maintenance. The stored non-uniformity map can also be used for printing multiple images (steps 450-480 shown in FIG. 4). A non-uniformity map can be produced by measuring either densities, as in FIG. 4, or potentials, as in FIG. 5.

In a printer with multiple rotatable components (belts or drums), one or more of those components can have intentional variations. The intentional variations of different components can have different magnitudes and frequencies that uniquely identify them, or the same magnitudes or frequencies. In embodiments using different magnitudes or frequencies, the processor can identify the intentional variations present, e.g., by FFT analysis, then correlate the frequencies of those variations with the frequencies of noise terms observed in the measured data of the points to determine which rotatable member is introducing which unintentional variation.

Compensation for intentional or unintentional variations can be performed in various ways. Ways useful with various embodiments include those described in commonly assigned, co-pending U.S. Patent Publication No. 2010/0097657, filed Oct. 12, 2009, entitled "Adaptive Exposure Printing And Printing System," by Kuo et al., and commonly assigned, U.S. patent application Ser. No. 12/748,762, filed Mar. 29, 2010, entitled "Screened Hardcopy Reproduction Apparatus Compensation," by Tai, et al., the disclosures of which are incorporated herein by reference.

In an embodiment, the test patch is formed (FIG. 12 step 415) at a given aim density. The amount of variation, whether intentional or unintentional, is the measured density minus the aim density, or the measured potential minus the potential corresponding to the aim density. The amount of variation is stored. To determine the correction value (FIG. 12 step 1265), the variation amount corresponding to the region angular position is retrieved from memory, or interpolated from one or more stored variation amounts. To adjust the image data (FIG. 12 step 470), the correction value is subtracted from the image data of the region. In an example, the aim density is 2.0. The reproduced density at 150° is 2.1, so the amount of variation is +0.1. This amount represents the effect of the intentional variation and the unintentional variation, taken together. The reproduced density at 180° is 2.2, so the amount of variation is +0.2. The correction value ν for 165°, halfway between the two readings, is determined by linear interpolation to be $$\nu=[(165°-150°)/(180°-150°)]\times(0.2-0.1)+0.1=0.15.$$

The image data for 165° is thus adjusted by subtracting 0.15. When the image data specifies a density of 1.5, the adjusted image data specifies a density of 1.35. Since the reproduced densities are higher than the aim densities, the printer will print the region at 165° close to a density of 1.5.

In various embodiments, the correction values can be subtracted from the image data (additive correction), or divided into the image data (multiplicative correction). For example, if the reproduced density at 165° is 2.5 for an aim of 2.0, the amount of variation can be determined to be 2.5/2.0=×1.25. The adjusted image data can therefore be 1.5/1.25=1.2.

In another embodiment, two test patches are formed at two or more different aim density levels, e.g., 1.0 and 2.0. The measurements at each point are combined by curve fitting as a function of aim density to produce a curve relating aim density to reproduced density. In an example, the reproduced density for an aim of 1.0 is 1.6, and an aim of 2.0 is reproduced as 2.2. The linear fit through these two points is $$\text{reproduced density}=(0.6\times\text{aim density})+1.0$$

so the inverse of that relationship, as used for adjusting image data, is $$\text{adjusted density}=(5/3\times\text{reproduced density})-5/3.$$

This inverse is used to determine the adjusted density to be supplied to the printer as adjusted image data for a desired reproduced density matching a desired aim density. To reproduce a density of 1.8 on the printer, for example, the image data would be adjusted to 4/3≈1.333. Linear, log, exponential, power, polynomial, or other fits can be used. The more points are used to make the fit, the more finely the actual variation can be represented, up to the amount of memory selected to be used for coefficients and measurements. As a result, adjusting the image data can include applying gains or offsets, taking powers, and other mathematical operations corresponding to the type of fit used. Corrections or fits can be made for the intentional and unintentional variation taken together or can be made for the intentional variation or unintentional variation separately. The image data can be adjusted to correct for intentional variation, and adjusted separately to additionally correct for unintentional variation.

In various embodiments, the test patch extends in the cross-track direction, and the measurement points are spread across the test patch. In other embodiments, multiple test patches arranged along the cross-track direction are used. In any of these embodiments, different amounts of variations are determined for different points along the cross-track axis. Image data adjustments are made using the fits or variation amounts for the corresponding, closest, or interpolated cross-track position.

In various embodiments, image-formation variables are adjusted rather than, or in addition to, image data. For example, the voltage of the toning shell or photoreceptor, the charger voltage, the maximum photoreceptor exposure, and the developer flow rate can be adjusted to compensate for the unintentional variation. For example, for unintentional variation due to runout on a toning roller, the toning roller bias voltage can be varied in sync with the runout to provide higher electrostatic toning forces when the gap is larger and lower forces when the gap is smaller.

Figure 7:
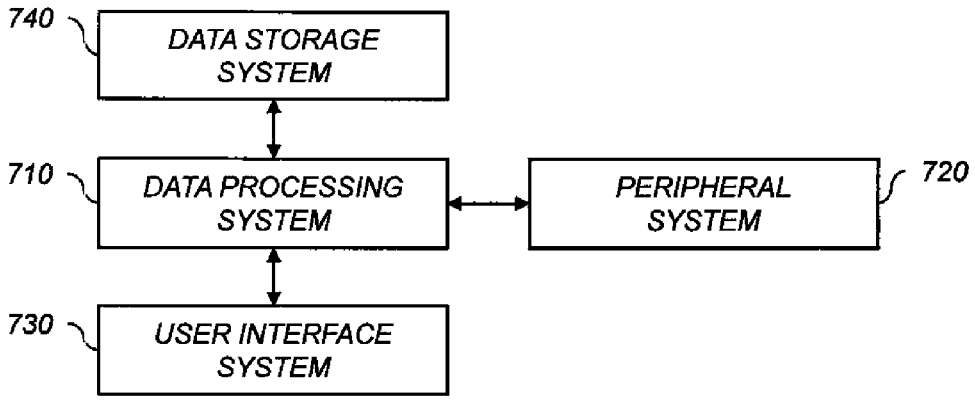
FIG. 7 is a high-level diagram showing the components of a computational system for providing non-uniformity maps and performing compensation according to various embodiments.

FIG. 7 is a high-level diagram showing the components of a computational system for providing non-uniformity maps and performing compensation according to various embodiments. The system includes a data processing system 710, a peripheral system 720, a user interface system 730, and a data storage system 740. The peripheral system 720, the user interface system 730 and the data storage system 740 are communicatively connected to the data processing system 710.

The data processing system 710 includes one or more data processing devices that implement the processes of various embodiments described herein. The phrases "data processing device" or "data processor" are intended to include any data processing device, such as a central processing unit ("CPU"), a desktop computer, a laptop computer, a mainframe computer, a personal digital assistant, a Blackberry™, a digital camera, cellular phone, or any other device for processing data, managing data, or handling data, whether implemented with electrical, magnetic, optical, biological components, or otherwise. LCU 99 (FIG. 1) is an example of a data processing system 710.

The data storage system 740 includes one or more processor-accessible memories configured to store information, including the information needed to execute the processes of various embodiments described herein. The data storage system 740 can be a distributed processor-accessible memory system including multiple processor-accessible memories communicatively connected to the data processing system 710 via a plurality of computers or devices. Alternatively, the data storage system 740 can include one or more processor-accessible memories located within a single data processor or device.

The phrase "processor-accessible memory" includes any processor-accessible data storage device, whether volatile or nonvolatile, electronic, magnetic, optical, or otherwise, including but not limited to, registers, floppy disks, hard disks, Compact Discs, DVDs, flash memories, ROMs, and RAMS.

The phrase "communicatively connected" includes any type of connection, wired or wireless, between devices, data processors, or programs in which data can be communicated. The phrase "communicatively connected" also includes a connection between devices or programs within a single data processor, a connection between devices or programs located in different data processors, and a connection between devices not located in data processors at all. Although the data storage system 740 is shown separately from the data processing system 710, one skilled in the art will appreciate that the data storage system 740 can be stored completely or partially within the data processing system 710. Similarly, although the peripheral system 720 and the user interface system 730 are shown separately from the data processing system 710, one skilled in the art will appreciate that one or both of such systems can be stored completely or partially within the data processing system 710.

The peripheral system 720 can include one or more devices configured to provide digital content records to the data processing system 710. For example, the peripheral system 720 can include digital still cameras, digital video cameras, cellular phones, or other data processors. The data processing system 710, upon receipt of digital content records from a device in the peripheral system 720, can store such digital content records in the data storage system 740.

The user interface system 730 can include a mouse, a keyboard, another computer, or any device or combination of devices from which data is input to the data processing system 710. In this regard, although the peripheral system 720 is shown separately from the user interface system 730, the peripheral system 720 can be included as part of the user interface system 730.

The user interface system 730 also can include a display device, a processor-accessible memory, or any device or combination of devices to which data is output by the data processing system 710. In this regard, if the user interface system 730 includes a processor-accessible memory, such memory can be part of the data storage system 740 even though the user interface system 730 and the data storage system 740 are shown separately in FIG. 7.

Various embodiments described herein can be used individually, or combined, to compensate for non-uniformity of multiple imaging components in the printer. For example, potentials can be measured as shown in FIG. 5 to correct for nonuniformities due to the photoreceptor. Densities can be measured as shown in FIG. 4 to correct for nonuniformities due to the toning shell or other toning member. The voltage effects can optionally be subtracted from the density effects to separate the compensations for the two sources of error. Compensation can be performed for any number of components.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)

100 printer
102, 103 roller
104 transmission densitometer
105 power supply
109 interframe area
110 light beam
111, 121, 131, 141, 151 imaging member
112, 122, 132, 142, 152 transfer member
113, 123, 133, 143, 153 transfer backup member
124, 125 corona tack-down chargers
201 transfer nip
202 second transfer nip
206 photoreceptor
210 charging subsystem

PARTS LIST

Continued

211 meter
212 meter
213 grid
216 surface
220 exposure subsystem
225 development substation
226 toning shell
227 magnetic core
240 power source
410 provide printer step
415 form test patch with intentional variation step
420 measure densities step
425 detect phase of intentional variation and amounts of unintentional variation step
430 produce non-uniformity map step
450 receive image signal with multiple regions step
455 rotate component and detect reference phase step
460 determine region phase step
465 determine correction value step
470 adjust image data of region step
475 deposit toner step
480 more regions decision step
510 provide printer with photoreceptor step
515 form test target step
520 measure potentials step
525 detect phase of intentional variation and amount of unintentional variation step
610, 620, 630 curve
650, 670, 680, 690 marker
710 data processing system

PARTS LIST

Continued

720 peripheral system
730 user interface system
740 data storage system
810 curve
842*a*, 842*b*, 842*c*, 842*d* receiver
843*a*, 843*b*, 843*c*, 843*d* phase
850*a*, 850*c*, 850*d* defect area
910 drum
920 axle
931 circle
950 sensor
1010 drum
1110 drum
1225 detect angular positions of intentional variation and amounts of unintentional variation step
1230 produce non-uniformity map step
1255 rotate component step
1260 determine region angular position step
1265 determine correction value step
ITM1-ITM5 intermediate transfer member
PC1-PC5 imaging member
$R_n$-$R_{(n-6)}$ receiver
S slow-scan direction
TR1-TR5 transfer backup member

The invention claimed is:

1. A method of compensating for non-uniformity in an electrophotographic printer, comprising:

providing the electrophotographic printer with a rotatable imaging component having an intentional periodic variation;

forming a test patch by depositing toner on a test surface using the rotatable imaging component, the test patch having a length;

measuring the respective densities of a plurality of points along the length of the test patch using a density sensor;

using a processor to automatically detect, using the measured densities, respective angular positions of the intentional periodic variation in the test patch and respective amounts of an unintentional periodic variation in the test patch at one or more of the plurality of points;

using the processor to automatically produce a non-uniformity map that relates the detected angular positions with the detected amounts at one or more of the plurality of points receiving an image signal representing a print image to be deposited on a receiver by the printer, the image signal including a plurality of regions arranged around the rotatable imaging component;

rotating the rotatable imaging component and, for each successive region in the image signal:

determining a region angular position of the intentional variation in the region;

using the produced non-uniformity map to determine a correction value corresponding to the determined region angular position;

automatically adjusting the image data of the region with the correction value using the processor; and depositing toner corresponding to the adjusted image data of the region on the receiver using the rotatable imaging component.

2. The method according to claim 1, wherein the rotating step further includes detecting a reference phase of the intentional periodic variation corresponding to a selected reference point in the image signal, and the region angular position is determined using the reference phase.

3. The method according to claim 1, wherein the providing step further includes providing the printer with a second imaging component, and the forming step includes transferring toner from the rotatable imaging component to the second imaging component, and then from the second imaging component to the test surface.

4. The method according to claim 1, wherein the processor produces the non-uniformity map so that the non-uniformity map relates the detected angular positions of the intentional periodic variation to the amounts of the unintentional variation and also to the respective amounts of the intentional variation at one or more of the plurality of points.

5. The method according to claim 1, wherein the average amount of unintentional variation is smaller than the average amount of intentional variation.

6. The method according to claim 1, wherein the intentional variation has a spatial frequency higher than a selected threshold spatial frequency.

7. The method according to claim 1, wherein the intentional variation includes a pseudo-random sequence.

8. A method of compensating for non-uniformity in an electrophotographic printer, comprising:

providing the electrophotographic printer with a rotatable photoreceptor having an intentional periodic variation;

forming a test target by image-wise charging the surface of the photoreceptor, the test target having a length;

measuring the respective potentials of a plurality of points along the length of the test target;

using a processor to automatically detect, using the measured potentials, respective angular positions of the intentional periodic variation in the test target and respective amounts of an unintentional periodic variation in the test target at one or more of the plurality of points;

using the processor to automatically produce a non-uniformity map that relates the detected angular positions with the detected amounts at one or more of the plurality of points;

receiving an image signal representing a print image to be deposited on a receiver by the printer, the image signal including a plurality of regions arranged around to the rotatable imaging component; and rotating the rotatable imaging component, and, for each successive region in the image signal:

determining a region angular position of the intentional variation in the region;

using the produced non-uniformity map to determine a correction value corresponding to the determined region angular position;

automatically adjusting the image data of the region with the correction value using the processor; and depositing toner corresponding to the adjusted image data of the region on the receiver using the rotatable imaging component.

9. The method according to claim 8, wherein the rotating step further includes detecting a reference phase of the intentional periodic variation corresponding to a selected reference point in the image signal, and the region angular position is determined using the reference phase.

10. The method according to claim 8, wherein the processor produces the non-uniformity map so that the non-uniformity map relates the detected angular positions of the intentional periodic variation to the amounts of the unintentional variation and also to respective amounts of the intentional variation at one or more of the plurality of points.

11. The method according to claim 8, wherein the average amount of the unintentional variation is smaller than the average amount of the intentional variation.

12. The method according to claim 8, wherein the intentional variation has a spatial frequency higher than a selected threshold spatial frequency.

13. The method according to claim 8, wherein the intentional variation includes a pseudo-random sequence.

14. A method of producing a non-uniformity map of an electrophotographic printer, comprising:

providing the electrophotographic printer with a rotatable imaging component having an intentional periodic variation;

forming a test patch by depositing toner on a test surface using the rotatable imaging component, the test patch having a length;

measuring the respective densities of a plurality of points along the length of the test patch using a density sensor;

using a processor to automatically detect, using the measured densities, respective angular positions of the intentional periodic variation in the test patch and respective amounts of an unintentional periodic variation in the test patch at one or more of the plurality of points; and using the processor to automatically produce the non-uniformity map that relates the detected angular positions with the detected amounts at one or more of the plurality of points.

15. The method according to claim 14, wherein the average amount of the unintentional variation is smaller than the average amount of the intentional variation at one or more of the plurality of points.

16. The method according to claim 14, wherein the intentional variation has a spatial frequency higher than a selected threshold spatial frequency.

17. The method according to claim 14, wherein the intentional variation includes a pseudo-random sequence.

18. A method of producing a non-uniformity map of an electrophotographic printer, comprising:

providing the electrophotographic printer with a rotatable photoreceptor having an intentional periodic variation;

forming a test target by image-wise charging the surface of the photoreceptor, the test target having a length;

measuring the respective potentials of a plurality of points along the length of the test target;

using a processor to automatically detect, using the measured potentials, respective angular positions of the intentional periodic variation in the test target and respective amounts of an unintentional periodic variation in the test target at one or more of the plurality of points; and using the processor to automatically produce the non-uniformity map that relates the detected angular positions with the detected amounts at one or more of the plurality of points.

19. The method according to claim 18, wherein the average amount of the unintentional variation is smaller than the average amount of the intentional variation.

20. The method according to claim 18, wherein the intentional variation has a spatial frequency higher than a selected threshold spatial frequency.

21. The method according to claim 18, wherein the intentional variation includes a pseudo-random sequence.

* * * * *